US006377002B1

(12) United States Patent
Ge et al.

(10) Patent No.: US 6,377,002 B1
(45) **Date of Patent: *Apr. 23, 2002**

(54) COLD CATHODE FIELD EMITTER FLAT SCREEN DISPLAY

(75) Inventors: Shichao Ge, San Jose; Lap Man Yam, Saratoga; Charles S. Leung; Xi Huang, both of San Jose, all of CA (US)

(73) Assignee: Pixtech, Inc., Santa Clara, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/736,894

(22) Filed: Oct. 25, 1996

Related U.S. Application Data

(63) Continuation-in-part of application No. 08/306,486, filed on Sep. 15, 1994, now abandoned.
(60) Provisional application No. 60/005,876, filed on Oct. 26, 1995.

(51) Int. Cl.[7] ..... G09G 1/04; G09G 3/10; H01J 29/70
(52) U.S. Cl. ..... 315/366; 315/169.1; 313/422
(58) Field of Search ..... 315/366, 169.1; 313/422, 257, 243, 310, 309

(56) References Cited

U.S. PATENT DOCUMENTS

| | | | |
|---|---|---|---|
| 3,935,499 | A | 1/1976 | Oess |
| 3,935,500 | A | 1/1976 | Oess et al. |
| 4,112,329 | A | 9/1978 | Veith |
| 4,158,210 | A | 6/1979 | Watanabe et al. |
| 4,183,125 | A | 1/1980 | Meyer et al. |

(List continued on next page.)

FOREIGN PATENT DOCUMENTS

| | | |
|---|---|---|
| EP | 0261896 | 3/1988 |
| JP | 5887741 | 5/1983 |
| JP | 6037640 | 2/1985 |
| JP | 6210848 | 1/1987 |
| JP | 6252846 | 3/1987 |

(List continued on next page.)

OTHER PUBLICATIONS

"Sealed Vacuum Dees: Florscnt Motiisys," A. Ghis et al., *IEEE Transactions on Electron Devices*, vol. 38, No. 10, Oct. 1991, pp. 2320–2322.
"Degradation Mechanism for Low Voltage Chatodoluminescence of Sulfide Phosphors," S. Itoh et al., *J. Electrochm. Soc.*, vol. 136, No. 6, Jun. 1989, pp. 1819–1823.
"Field–Emitter Arrays Applied to Vacuum Fluorescent Display," C. Spindt et al., *IEEE Transactions on Electron Devices*, vol. 36, No. 1, Jan. 1989, pp. 225–228.
"8.1: A 15–mm Tri–Pitch Jumbotron Device," M. Hayashi et al., *SID 89 Digest*, pp. 98–101.
"6" Diagonal Microtip Fluorescent Display for T.V. Applications, R. Meyer, pp. 374–377.

*Primary Examiner*—Gregory C. Issing
(74) *Attorney, Agent, or Firm*—Samuels, Gauthier & Stevens, LLP

(57) ABSTRACT

Strips of field emitters arranged in rows overlap grid electrodes when viewed in the viewing direction to define pixel dots. Scanning electrical voltages are applied to the rows of field emitters to perform scanning and data potentials are applied to the grid electrodes to control the brightness of the display. Potentials applied to the grid electrodes also focus the electrons from the field emitters. A metal mesh with grid electrodes fabricated thereon to form an integrated structure greatly simplifies the manufacture of the display.

36 Claims, 12 Drawing Sheets

U.S. PATENT DOCUMENTS 4,340,838 A 7/1982 Kobale et al.
4,377,769 A 3/1983 Beatty et al.
4,651,049 A 3/1987 Saeki et al.
4,707,638 A 11/1987 Hara et al.
4,719,388 A 1/1988 Oess
4,737,683 A 4/1988 Shichao et al.
4,857,799 A 8/1989 Spindt et al.
4,955,681 A 9/1990 Sekihara et al.
4,973,888 A 11/1990 Morimoto et al.
5,075,595 A * 12/1991 Kane ..... 315/169.1
5,103,144 A * 4/1992 Dunham ..... 315/366
5,126,628 A 6/1992 Kishimoto et al.
5,170,100 A 12/1992 Shichao et al.
5,191,217 A 3/1993 Kane et al.
5,194,780 A 3/1993 Meyer
5,205,770 A 4/1993 Lowrey et al.
5,229,691 A 7/1993 Shichao et al.
5,283,500 A * 2/1994 Kochanski ..... 315/169.1
5,300,862 A * 4/1994 Parker et al. ..... 315/169.1
5,347,201 A * 9/1994 Liang et al. ..... 315/366
5,347,292 A 9/1994 Ge et al.
5,413,513 A 5/1995 Horne et al.
5,424,605 A 6/1995 Lovoi
5,430,459 A 7/1995 Clerc
5,436,530 A 7/1995 Suzuki et al.
5,528,103 A 6/1996 Spindt et al.
5,541,473 A 7/1996 Duboc, Jr. et al. ..... 313/422
5,565,742 A 10/1996 Shichao et al.
5,589,731 A * 12/1996 Fahlen et al. ..... 313/495

FOREIGN PATENT DOCUMENTS

JP 52108435 5/1987
JP 62150634 7/1987
JP 62150635 7/1987
JP 62150637 7/1987
JP 62150638 7/1987
JP 62150639 7/1987
JP 62150640 7/1987
JP 62172638 7/1987
JP 62172639 7/1987
JP 62172644 7/1987
JP 62172645 7/1987
JP 62188139 8/1987

* cited by examiner

COLD CATHODE FIELD EMITTER FLAT SCREEN DISPLAY

CROSS REFERENCE TO DISCLOSURE DOCUMENT AND RELATED APPLICATIONS

This application is a continuation-in-part application of provisional application No. 60/005,876 filed Oct. 26, 1995, now expired and continuation-in-part of U.S. patent application Ser. No. 08/306,486 filed Sep. 15, 1994 now abandoned. This application is also related to disclosure document No. 405,371 filed on Aug. 9, 1996, so that the disclosure document will be retained as a part of the file history of this application.

BACKGROUND OF THE INVENTION

This invention relates in general to flat panel display structures and, in particular, to flat panel displays employing cold cathode field emitters.

Flat panel displays have a growing number of applications that benefit from their thin profile and light weight. These include active and passive liquid crystal displays (AMLCD, LCD), AC and DC plasma displays (PDP), electroluminescent (EL) displays, field emission displays (FEDs) and flat matrix cathode ray tube (CRT) displays. AMLCDs, however, are expensive to make. Furthermore, because of low yield, it may be difficult to manufacture large screen AMLCDs. Thus, even though AMLCDs have dominated the notebook computer and high information graphics display market, its potential for large screen full video speed flat panel displays appears to be limited.

The emissive type flat panel displays such as flat matrix CRTs and plasma discharge panel (PDP)displays are disadvantageous because power consumption is high. Flat CRT displays employing cathode filaments that extend across the length of the display have also been proposed. See, for example, U.S. Pat. No. 5,170,100. While such thermionic emission displays have been proven to be reliable in operation and can be manufactured in large volume at low cost, it is believed that these devices may still have weaknesses when used in large area flat panel display systems. Thus, thermionic cathode filaments have to be mounted with springs on both ends and proper tension need to be set to reduce vibrations. Heat loss to the filament supports by contact results in cold terminal effects that degrades electron emission at both ends of the filament. The filaments have to be operated at an elevated temperature which may adversely affect phosphor efficiency and lifetime. Filament array mounting may be difficult for cost effective high throughput manufacturing.

Field emitters have been used in flat panel displays and vacuum microelectronics applications. Cold cathode and field emission based flat panel displays have several advantages over other types of flat panel displays. These include low power consumption, high brightness, improved viewing angle and reduced manufacturing complexity and costs, compared to AMLCDs, for example. However, the perfection of large area panels using this technology in the conventional manner is problematic because of the need to fabricate high density identical sharp microtips. For this reason, FED panels suffer from the same high costs and low yield issues similar to that encountered in the fabrication of AMLCDs. This is explained in more detail below.

Each field emitter includes typically a base electrode and a gate electrode. The display is controlled typically by applying a scanning electrical potential to rows of base electrodes or gate electrodes and the data modulation electrical potential to columns of the remaining electrodes in an X-Y addressing scheme for controlling the brightness of the display at each pixel corresponding to one or more groups of microtips. Therefore, the brightness at each pixel would depend on the emission characteristics of the corresponding group or groups of field emitters. Since individual field emitters may have different current-voltage characteristics resulting from variations in the manufacturing process, such field emitters may have different electron emission characteristics, thereby causing differences in brightness. While the variation in brightness due to such factor may still be tolerable for small screen display, the extension of such conventional FED panels to large screen flat panels appears to be difficult.

Furthermore, each microtip emits electrons within a large angle cone about the axis of the microtip, a small standoff distance must be maintained between the gate of the field emitter and the anode of the display. If a large standoff distance is maintained between the gate and the screen, electrons emitted from the microtip will spread laterally, resulting in significant cross talk and low resolution display. To avoid such problems, a small standoff distance is maintained between the anode on the one hand and the gate of the microtips on the other. This means that the potential difference between the anode and the field emitters must be small; otherwise, the high anode voltage would overpower the gate of the field emitters and simply turn every pixel in the display to the on state indefinitely, so that there is simply no display of any image. For this reason, the device must be operated at low voltage, so that even though high efficiency phosphors are used, they do not operate efficiently at such low voltages.

In addition, since the addressing is by controlling the gate and base electrodes of each individual microtip array, each row and column of the display must be controlled in an X-Y addressing. For a display of 640 rows by 480 columns, there must be 640 electrical connections for the 640 rows and 480 for the columns, so that it is cumbersome and costly to implement a row and column integrated circuit driver for television.

In view of the above disadvantages of conventional FED panels, alternatives have been proposed, such as the system in U.S. Pat. No. 5,347,201. In the system of U.S. Pat. No. 5,347,201, field emitter arrays are used to replace cathode filaments in electron fluorescent displays. In the proposed system, cold cathode field emitters are used as electron sources in the place of cathode filaments, and three sets of grid electrodes are used to control the scanning and data modulation of brightness of the display. In such scheme, however, three sets of electrodes need to be mounted accurately, which may be tedious.

None of the above-described structures is entirely satisfactory. It is, therefore, desirable to provide an improved flat panel display in which the above-described difficulties are avoided or reduced.

SUMMARY OF THE INVENTION

The first aspect of the invention is directed towards a cathodoluminescent visual display device having a plurality of pixel dots for displaying images when said device is viewed in a viewing direction. The device comprises a housing defining a chamber therein, said housing having a face plate and a back plate; an anode on or near said face plate and luminescent means that emit light in response to electrons, and that is on or adjacent to the anode. The device further comprises a plurality of rows of field emission cathode elements in the chamber between the face and back plates; a first spacer structure defining holes therein for passage of electrons and a first set of elongated grid electrodes between the anode and cathode, the electrodes overlapping the luminescent means and said rows at locations when viewed in the viewing direction, wherein the overlapping locations define pixel dots. The device further includes means for applying electrical potentials to the anode, cathode, the set of grid electrodes and the rows of field emission cathode elements, causing the cathode elements to emit electrons, and such electrons to travel to the luminescent means at desired pixel dots on or adjacent to the anode for displaying images of desired brightness.

Another aspect of the invention is directed towards a method for making a display device having a spacer structure, comprising processing a layer of metal to form a metal mesh with holes therein of a predetermined pattern; applying an insulating coating onto the metal mesh; forming a grid electrode pattern on the insulating layer and inserting said spacer structure between an anode and at least one cathode to form said display device.

Yet another aspect of the invention is directed towards a method for displaying images by means of a cathodoluminescent visual display device. The device comprises an anode; luminescent means that emit light in response to electrons, and that is on or adjacent to the anode; a plurality of rows or field emission elements between the face and back plates; and a first set of elongated grid electrodes between the anode and cathode, the electrodes overlapping the luminescent means and said rows at locations when viewed in a viewing direction, wherein the overlapping locations define pixel dots. The method comprises causing rows of the cathode elements to emit electrons sequentially, wherein each row at a time is caused to emit electrons and applying electrical potentials to the anode, cathode and the set of grid electrodes, causing the electrons emitted by the cathode elements to travel to the luminescent means at desired pixel dots on or adjacent to the anode for displaying images of desired brightness.

One more aspect of the invention is directed towards a display device comprising luminescent means and a plurality of electron sources for emitting electrons toward the luminescent means at selected locations for displaying images. Each electron source comprises a base electrode; a gate electrode electrically insulated from the base electrode; a plurality of microtip structures and a first set of resistors, each resistor in the first set electrically connected to a corresponding microtip structure. Each electron source further comprises a substantially constant current source connected between the base electrode and the microtip structures to supply a substantially constant total amount of current to said plurality of microtip structures.

Yet one more aspect of the invention is directed towards a display device comprising luminescent means and a plurality of electron sources for emitting electrons towards the luminescent means at selected locations for displaying images, each electron source comprising a base electrode; a gate electrode electrically insulated from the base electrode; a plurality of microtip structures and a first set of resistors each resistor in the first set electrically connected to a corresponding structure. Each electron source further comprises a current limiting circuit connected to the resistors so that the resistors and circuit connect the base electrode to the microtip structures to limit total amount of current delivered by the base electrode to said plurality of microtip structures and means for supplying current to the base electrode to cause the microtips to emit electrons towards the luminescent means.

BRIEF DESCRIPTION OF THE DRAWINGS

For simplicity in description, identical parts in the different figures are identified by the same numerals.

DETAILED DESCRIPTION OF THE PREFERRED EMBODIMENT

Figure 1:
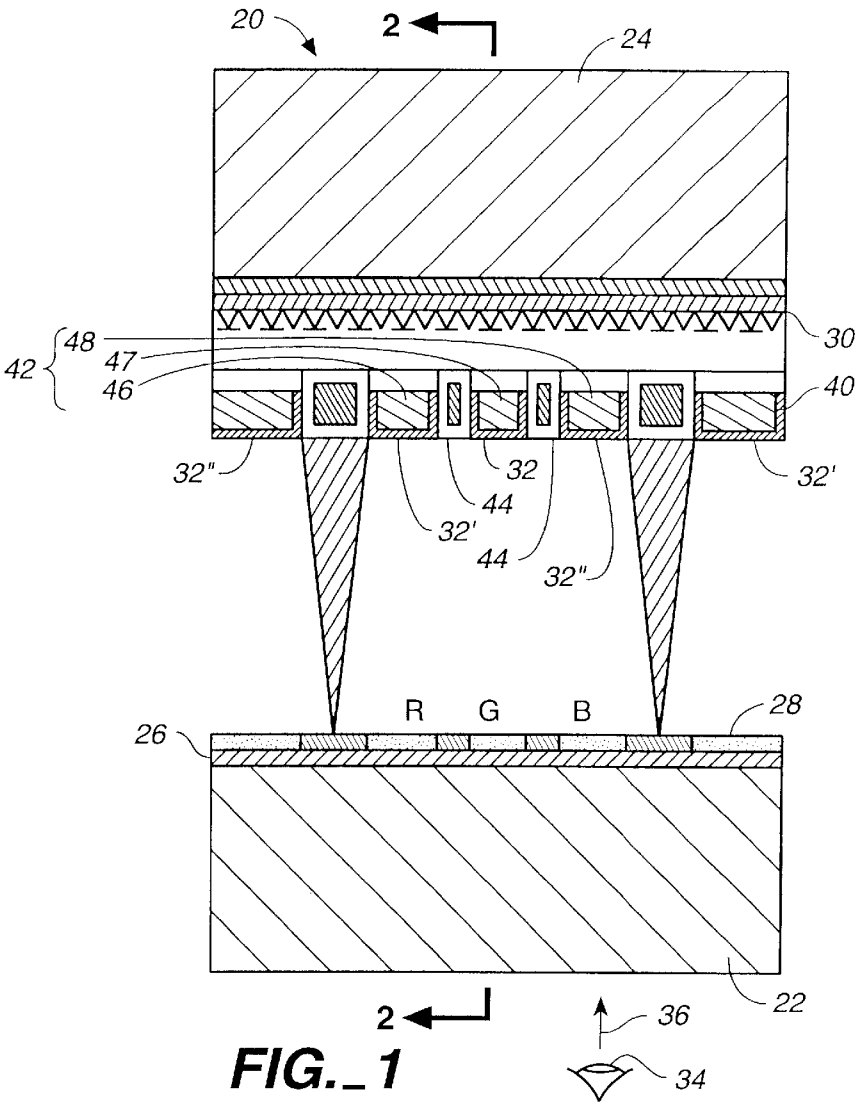
FIG. 1 is a cross-sectional side view of a portion of a cold cathode flat panel display device from the top or bottom side to illustrate an embodiment of the invention.
Figure 2:
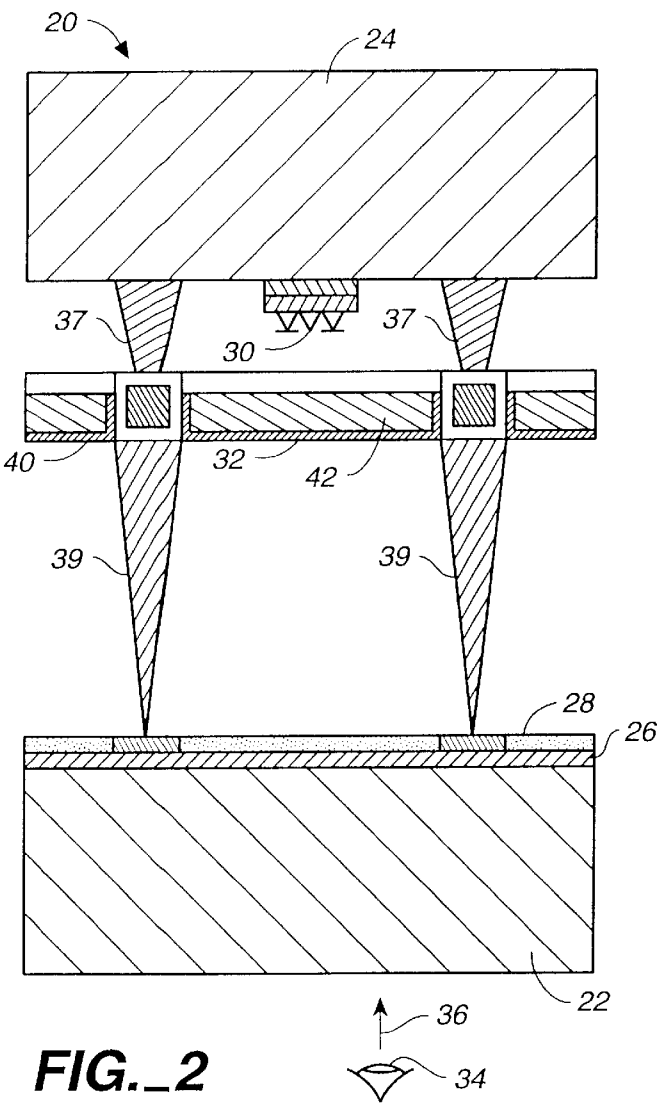
FIG. 2 is a cross-sectional view of the portion of the device of FIG. 1 taken along the line 2—2 in FIG. 1 from the left or right side of the device to illustrate the invention of FIG. 1.

FIGS. 1 and 2 are cross-sectional views of a display device viewed respectively from the top or bottom and from the side and employing cold cathode field emitter arrays and three spacers with one spacer integrated with grid electrodes to illustrate the invention. Thus, as shown in FIGS. 1 and 2, device 20 includes a transparent face plate 22 and a back plate 24 defining a chamber there between. The layer of electrically conductive material on the inside surface of the face plate serves as the anode 26 on top of which is a layer of luminescent material such as phosphor 28. On the inside surface of back plate 24 are arrays of cold cathode field emitters such as array 30 shown in FIGS. 1 and 2 for emitting electrons. Grid electrodes 32, 32', 32" control the amount of electrons that are passed from the field emitters in array 30 to phosphor 28 and therefore control the on/off switching as well as brightness of light from phosphor 28. The image so displayed is observed by an observer 34 along viewing direction 36. As illustrated in FIG. 1, the pattern of the three grid electrodes 32, 32' 32" is repeated from the left side to the right side of the display.

As shown in FIGS. 1 and 2, the arrays such as array 30 run from left to right and form rows of the display whereas the grid electrodes 32, 32', 32" run from top to bottom, preferably perpendicular to array 30, and form columns of the display. Thus, cross-sections of five grid electrodes 32, 32', 32" are shown in FIG. 1, where FIG. 2 is a cross-sectional view of the portion of device 20 shown in FIG. 1 taken along the line 2—2 in FIG. 1. Thus, grid electrode 32 and row 30 overlaps a pixel dot G of the phosphor layer 28 for emitting green light when impacted by electrons when viewed by an observer 34 along direction 36. Similarly, grid electrode 32' overlaps row 30 at pixel dot R of layer 28 for emitting red light when impinged by electrons when viewed along direction 36. Grid electrode 32" overlaps row 30 at pixel dot B of layer 28 for emitting blue light when impacted by electrons and viewed by the viewer 34 along viewing direction 36. In the preferred embodiment, scanning may be controlled by applying the appropriate electrical potentials to row 30 and similar rows that are not shown in FIGS. 1 and 2 and to grid electrodes 32, 32', 32" and other similar grid electrodes for controlling the brightness of the display.

The above described structure of the display greatly simplifies the method of X-Y addressing and the control circuit compared to those in conventional cold cathode field emission displays. In conventional cold cathode field emission displays, electrical potentials need to be applied to both the base and gate electrodes in order to accomplish X-Y addressing as well as brightness control. In contrast, row 30 of field emitters in FIGS. 1 and 2 need to be controlled only to turn on or turn off the microtips in the field emitters to either cause them to emit electrons or to cause them to stop emitting electrons; no brightness control is required in applying electrical potentials to row 30 or other rows in of field emitters in the display.

Device 20 is also advantageous over electro-fluorescent displays in that cathode filaments are now replaced by cold cathode field emitters so that all of the problems inherent in the use of cathode filaments are avoided.

Device 20 is further advantageous over conventional field emitter displays in that the field emitters in row 30 can be spaced much further apart from the anode 26 and phosphor layer 28 compared to conventional field emitter displays. Even though the electrons are emitted by the field emitters in a large cone angle and therefore may spread laterally if not otherwise redirected, the path of electrons can be shaped and controlled by potentials on the grid electrodes 32, 32', 32" so that the electrons are focused and directed towards the desired pixel dot or dots that are being addressed. For this reason, the spacing between the face and back plates can be made to be more than 0.5 mm; preferably the spacing is at least 1.5 mm. With such spacing, a high potential difference may be applied between the cold cathodes in row 30 and the anode 26, such as that of the order of several kilovolts and the phosphor layer 28 may be the high efficiency, high voltage type which greatly enhances the performance of the display. The above-described electron path shaping and focusing effect is illustrated in FIG. 3.

Figure 3:
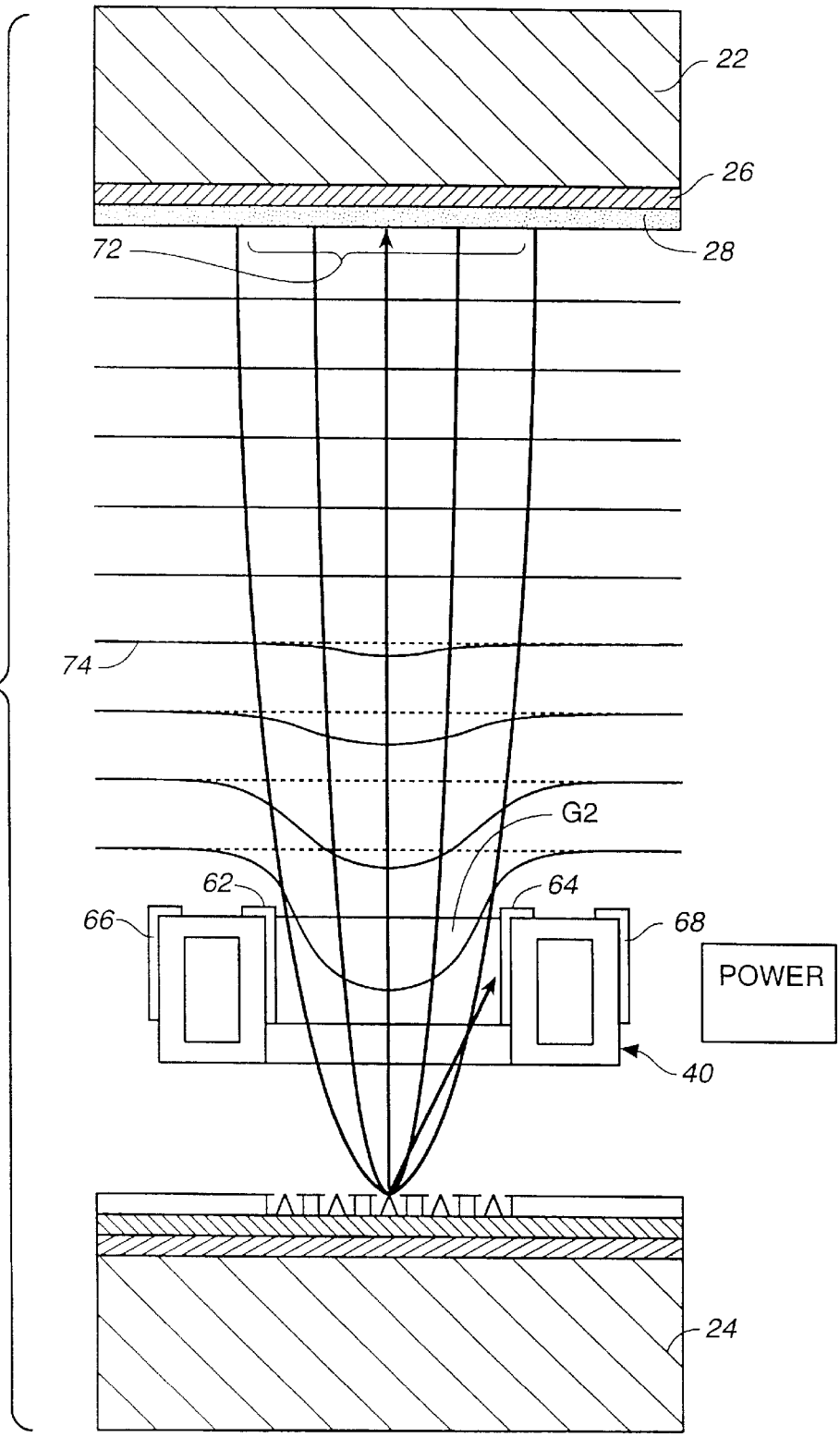
FIG. 3 is a cross-sectional view of a portion of the device in FIGS. 1 and 2 to illustrate electric field distribution and passage of electrons between the cold cathode field emitters and the anode when viewed from the top or bottom.

As shown in FIG. 3, even though the electrons emitted by a microtip would normally spread out within a large cone angle, this does not happen because such electrons are shaped by the electric field distribution due to the electrical potentials applied to grid electrodes 62, 64, 66 and 68. As a result, electrons originally emitted from the microtip within the large cone angle are focused and directed towards a pixel dot 72 as shown in FIG. 3. The grid potential lines 74 caused by the potentials applied to the grid electrodes are illustrated in FIG. 3.

A spacer 40 is placed between the face and back plates, where the space plate 40 contains holes 42 therein to permit passage of electrons. Spacer 40 also assists in aligning the paths of electrons from the field emitters with the desired pixel dot. Thus, as shown in FIG. 1, separating walls 44 in the spacer structure 40 divide larger hole 42 into three smaller holes 46, 47, 48, where at least one portion (the portion on the side towards the anode in FIGS. 1, 2) of the surface of hole 46 is coated by grid electrode 32', at least one portion of the surface of hole 47 is coated by grid electrode 32 and at least one portion of the surface of hole 48 is coated by grid electrode 32". When viewed by the observer 34 in the viewing direction 36, hole 46 overlaps the pixel dot R, hole 47 overlaps pixel dot G and hole 48 overlaps pixel dot B. Thus, by means of the alignment between the holes 46, 47, 48 with pixel dots R, G, B respectively, it would be easier to apply the appropriate electrical potentials to the corresponding grid electrodes 32', 32, 32" in order to focus electrons from array 30 towards the appropriate pixel dot, instead of to a neighboring unselected pixel dot (which is crosstalk).

A set of spacers 37 is placed between spacer 40 and the back plate 24, and a set of spacers 39 is placed between spacer 40 and the front plate 22 as shown in FIGS. 1 and 2 to support the face and back plates against atmospheric pressure. Spacer 40 may comprise a metal core coated with an insulating layer. The grid electrodes may then be formed by depositing a layer of metal on the insulating layer; some of the metal preferably is formed on the surface of the holes in the spacer as well as on a planar surface of the spacer facing either the anode or cathode elements.

The features above enable a relaxation of the requirement that the field emitters for addressing a particular pixel dot be accurately aligned with such pixel dot as is required in many conventional field emitter displays. In other words, a spatial structure 40 with holes aligned with the appropriate pixel dots together with the grid electrodes at the hole surfaces and the potentials applied thereto render device 20 robust against misalignment between the field emitters and the corresponding pixel dot. Such structure enables device 20 to be manufacturable in volume and at low cost.

Figure 4:
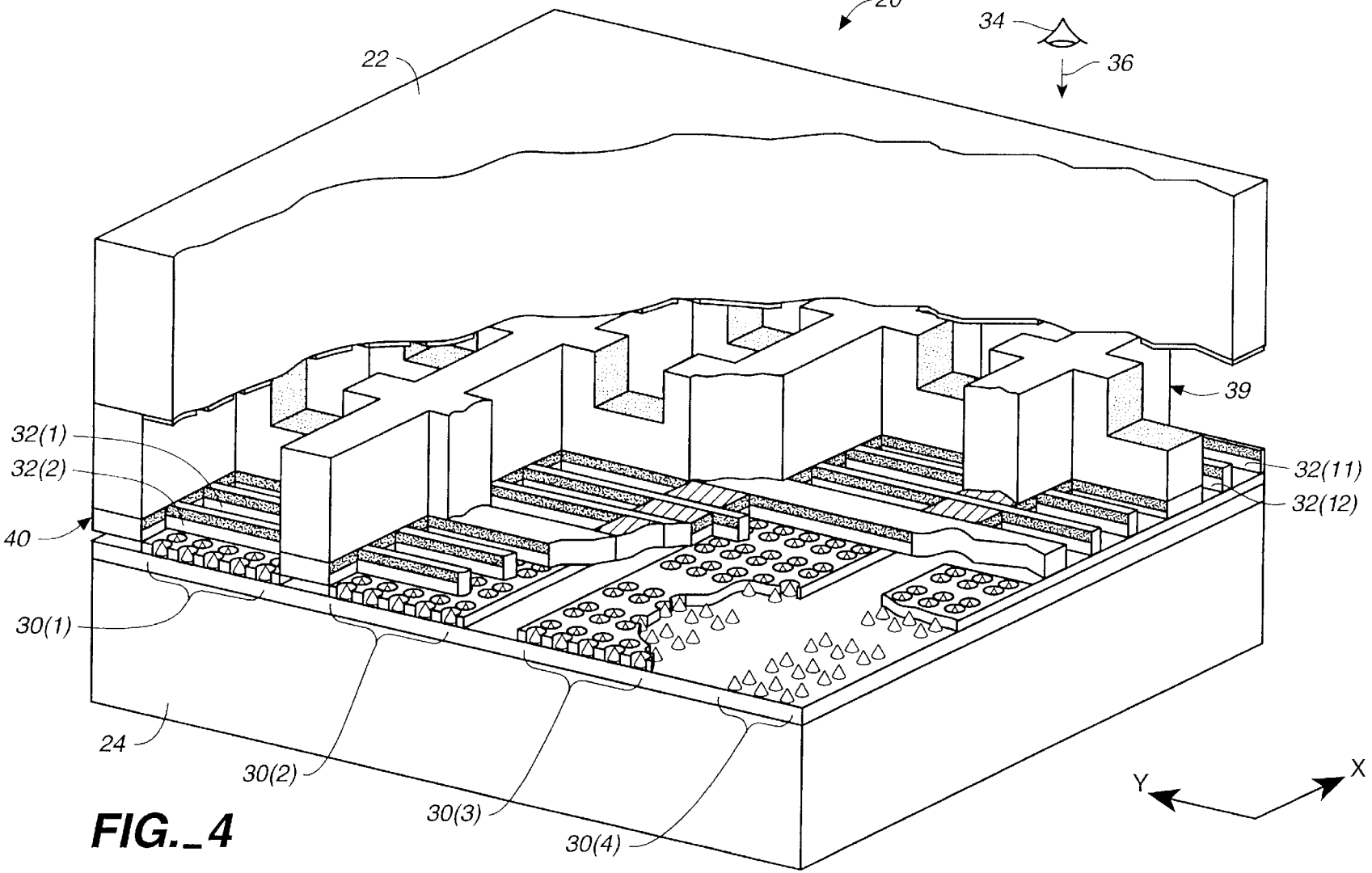
FIG. 4 is a perspective view of a portion of the display device of FIGS. 1–3 to illustrate the invention.

FIG. 4 is a perspective view of device 20 showing three rows of cold cathode field emitter arrays 30(1)–30(3), a portion of a fourth row 30(4), and twelve grid electrodes 32(1), 32(2), . . . , 32(12). Portions of the cold cathode field emitters, the grid electrodes, spacer 40 and face plate 22 have been removed and spacer 37 is also removed to show more clearly the interior of the device 20'. As shown in FIGS. 1 and 4, a group of pixel dots R, G, B form a pixel, so that the portion of the display device 20' contains sixteen pixels in a four-by-four configuration along the X and Y directions. Obviously, each pixel may include a different number of pixel dots, such as four dots comprising two green dots, a red and a blue dot; such and other variations are within the scope of the invention. In one embodiment, spacer 40 may have a thickness of at least about 0.05 mm.

The scanning of each of the cold cathode field emitters may be performed by applying the appropriate voltages to either the base electrode or the gate electrode, while keeping the electrical potential of the remaining electrode constant. For example, a constant voltage in the range of 0 to −1,000 volts may be applied to the base electrodes of all of the cold cathode field emitters, while scanning is accomplished by applying a voltage in the range of one volt to 200 volts to the gates of the field emitters in the selected row being scanned at the moment. The voltage applied to the grid electrodes such as 32, 32', 32", 62–68 may be in the range of −200 volts to +200 volts while the anode is at a constant voltage of at least one kilovolt and preferably one kilovolt to three kilovolts where the phosphor has no aluminum coating, and at four kilovolts to six kilovolts or higher where the phosphor has an aluminum coating.

Alternatively, addressing of the display 20, 20' may be accomplished by applying the appropriate voltages to the grid electrodes such as 32, 32', 32", 62–68 for scanning and to rows of cathode field emitters for controlling the switching on and off and the brightness of the display. Such and other variations are within the scope of the invention. Where the electrical potentials applied to the cold cathode field emitters are only for turning on and off the field emitters without modulating the brightness of the pixels, in contrast to conventional cold cathode field emitter displays, the integrated circuit drivers used in device 20, 20' can be much simpler than those required in conventional cold cathode field emitter displays.

Figure 5:
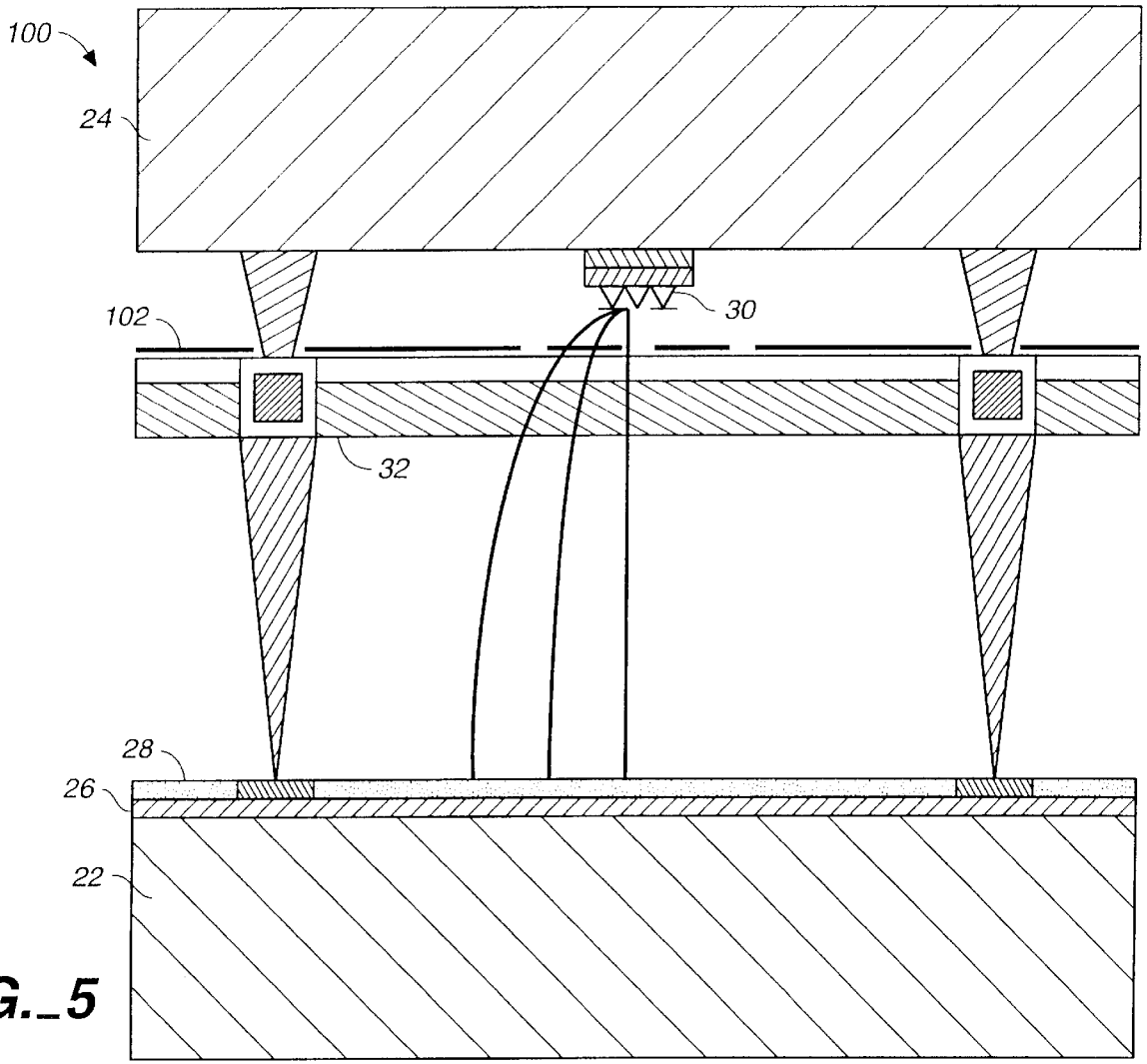
FIG. 5 is a schematic cross-sectional view of a portion of a cold cathode flat panel display device employing two sets of grid electrodes to illustrate another embodiment of the invention.

FIG. 5 is a cross-sectional view of a portion of the display device 100 substantially similar to device 20, except that an extra set of electrodes 102 is employed, where electrodes 102 are substantially parallel to the rows of cold cathode field emitters. The electrical potentials applied to electrodes 102 are also used for scanning. By controlling the electrical potentials both of the cold cathode field emitters and of electrodes 102, the circuit for scanning the rows of cold cathode field emitters can be greatly simplified. In principle, a single strip of field emitter array can be used to emit electrons for illuminating multiple scan lines, such as up to 50 scan lines. Once the field emitters in the array are turned on, then the multiple scan lines can be scanned by making use of grid electrodes 102. By applying the appropriate electrical potentials to the selected one of the grid electrodes 102 overlapping such single strip field emitter array, only the pixel dots overlapping such selected grid electrode will be addressed. As shown in FIG. 5, by applying the appropriate grid electrical potentials to the set of grid electrodes 102, the electrons emitted by row 30 may be caused to be focused onto one of a number (e.g. four) of lines of pixels, so that electrons emitted by row 30 may be used to scan a number of rows of pixels instead of only one row. Again, electrical potentials applied to grid electrodes such as 32 are used for controlling the brightness of the display.

In conventional cold cathode field emitter displays, one of the problems has been the non-uniformity of the display due to the fact that it is difficult to manufacture microtips having the same current-voltage (I–V) characteristics over a large area. Furthermore, after the display has been operated for a length of time, emitter defects increase and the brightness of the display declines to a certain point when the display has to be discarded.

Another aspect of the invention is based on the recognition that, by designing the cold cathode field emitter in such a manner that the total amount of current delivered by the array to a particular pixel dot or pixel remains constant over time, the display will be uniform in brightness at such dot or pixel. If this total current value can be achieved for substantially all of the pixels or pixel dots of the display, the display will be uniform in brightness. Such goals are accomplished by means of the cold cathode current field emitter structure of FIG. 6A.

Figure 6B:
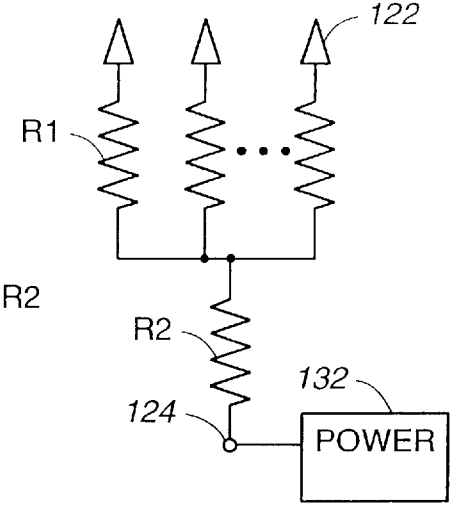
FIG. 6B is a circuit representation of the structure of FIG. 6A.
Figure 6A:
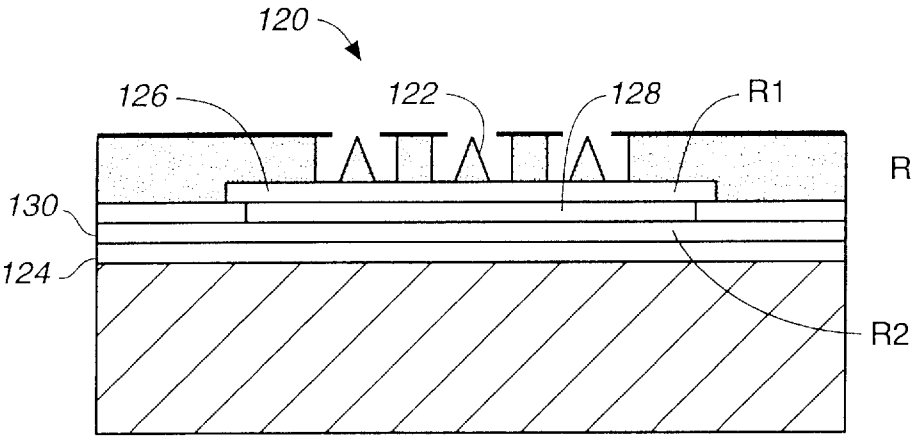
FIG. 6A is a cross-sectional view of a cold cathode field emitter array corresponding to a single pixel or pixel dot in the display of this invention to illustrate the preferred embodiment of the invention.

As in conventional field emitter structures, structure 120 includes a plurality of microtips where only three microtips 122 are shown for simplicity. In practice, each structure in a row may include thousands of microtips. The base of each microtip is connected to a base electrode 124 through a first resistive layer 126, a segmented thin film metal layer 128 and a second resistive layer 130 as shown in FIG. 6A. Layers 126, 130 have much higher resistivity compared to the metal layer 128. Therefore, the connection between each microtip 122 and base electrode 124 consists of the portions of the resistive layers 126, 130 and the portion of metal layer 128 in between the two resistive layers overlapping the microtip. Or the electrical circuit of the layers for the three microtips 122 can be represented schematically in FIG. 6B, where the resistance of the portion of the resistive layer 126 between the base of microtip 122 and the metal layer 128 is R1 and the resistance of the portion of the resistive layer 130 between the metal layer 128 and base electrode 124 is R2.

Thus, when power supply 132 supplies power to the base electrode 124, the resistance R2 of the resistive layer 130 limits the amount of current that is delivered by power supply 132 to the three microtips 122 through the corresponding resistors R1. Thus, resistors R2, R1 would guard against current surge and reduce damage to the microtips caused by such power surge. Furthermore, by limiting the total amount of current that is delivered to all of the microtips 122 in a particular cold cathode field emitter array for addressing a row of pixels, and by including redundant microtips in each array, the lifetime of the array can be enhanced several times over conventional structures. Since the presence of resistor R2 limits the total amount of current that is delivered to the microtips in the array and redundant emitters are added, not all of the emitters in the row will emit electrons, so that initially, some of the microtips either do not emit electrons or emit electrons at a lower rate. Whether a particular microtip will emit electrons or not depends on its I–V characteristics. After some period of operation of the display, the microtips that have been operating at full capacity will have shorter lifetimes compared to those not emitting electrons or emitting electrons at a lower rate. Thus, such fully operating microtips will become defective first. However, when this happens, the Applicants found that the microtips that have not been, to this point in time, emitting electrons or only emitting electrons at a lower rate will, in such circumstances, take up the slack and begin to either emit electrons where they did not before or emit electrons at a higher rate than before. In this manner, the total amount of current delivered by power supply 132 through resistors R2, R1 to the microtips 122 to be emitted as electrons, remain essentially constant, until such excess redundant microtips have also been used up. Thus, by using the cold cathode field emitter structure 120 of FIG. 6A together with the addition of redundant microtips to each array for addressing a row of pixels, the lifetime of the display can be increased several fold over conventional field emitter displays. This is illustrated in FIG. 7A.

Figure 6C:
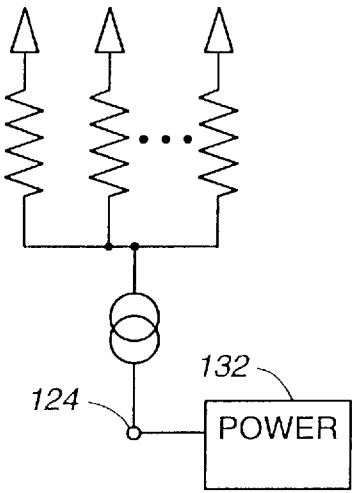
FIG. 6C is a circuit representation of an alternative embodiment to that in FIG. 6A to illustrate the invention.
Figure 7A:
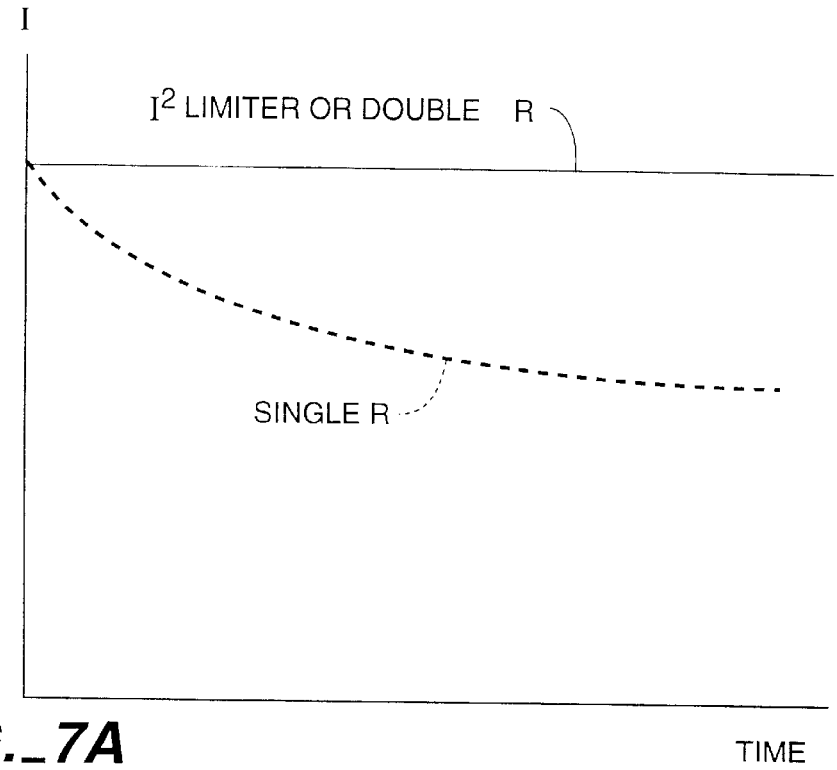
FIG. 7A is a graphical illustration of current delivered over time by conventional cold cathode field emitters, as well as that delivered by those of this invention in comparison to illustrate the invention.
Figure 7B:
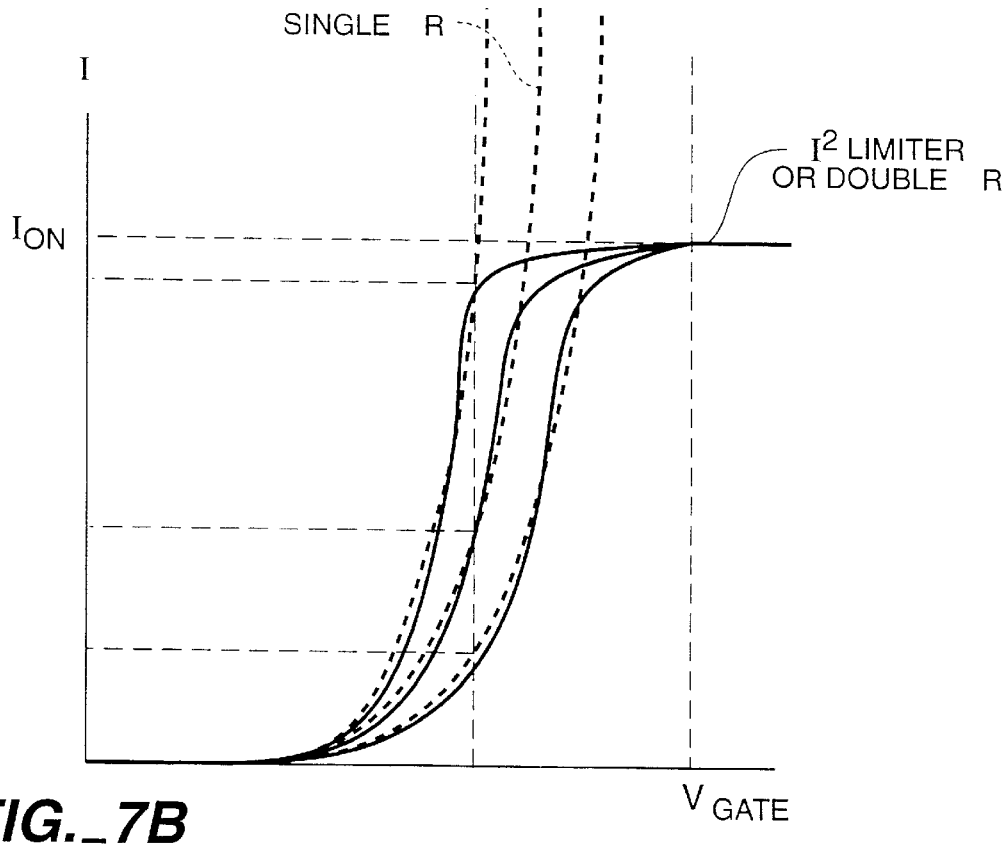
FIG. 7B are graphical illustrations of the I–V characteristics of field emitters.

As shown in FIG. 7A, where, as in conventional structures, the current is delivered by a power supply to the microtips with only a single resistor layer such as layer 126, the current declines over time along the dotted line in FIG. 7A. Where a second resistor such as R2 is also employed together with redundant microtips, the current remains constant for a much longer time in comparison with the conventional structure. Such substantially constant current is indicated by the solid line in FIG. 7A. FIG. 7B is a graphical illustration of the different types of $I_{0n}$–$V_{gate}$ or simply I–V characteristics of field emitters. If only a single resistor such as R1 is employed, the I–V characteristics are shown in dotted lines and labelled "single R"; hence, in such event, depending on the voltage applied, some microtips may turn on while others may not turn on at all. By employing an additional resistor R2 connected in series between the base electrode and a set of electrodes R1, the current delivered is limited to a value which is achievable over a wider range of voltages. In this manner, the additional resistor improves the performance of the field emitters. Instead of employing a simple resistive layer 130, essentially the same effect can be achieved by replacing the resistor by a substantially constant current source 150 as shown in FIG. 6C. The constant current source may, for example, be the drain/source path of a transistor (e.g. MOSFET) whose gate is controlled by a circuit (not shown in FIG. 6C). The advantage of using a transistor in such manner is that the total amount of current delivered by a power supply 132 to the base electrode and delivered to the microtips through resistors R1 can be adjusted by means of the control circuit for achieving a more uniform brightness across different pixels of the display. Such and other current sources may also be used and are within the scope of the invention.

Figure 8A:
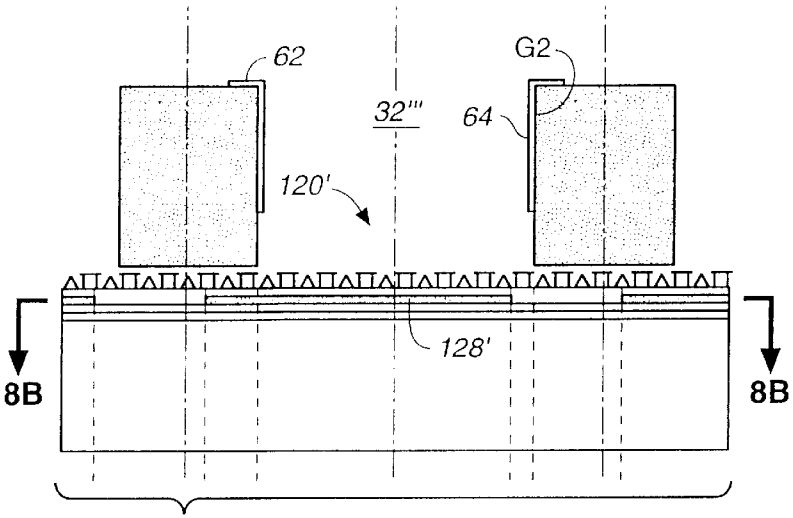
FIG. 8A is a cross-sectional view of a portion of a spacer, grid electrodes and cold cathode field emitter arrays to illustrate the invention.

FIG. 8A is a cross-sectional view of a portion of a spacer, grid electrodes 62, 64 and cold cathode field emitter structure similar to that in FIG. 6A to illustrate the invention. AS shown in FIG. 8A, the segmented thin film metal layer 128' is misaligned relative to the hole 32'''. Such misalignment is shown more clearly in FIG. 8B which is a top view of the field emitter array taken along the line 8B—8B in FIG. 8A.

Figure 8B:
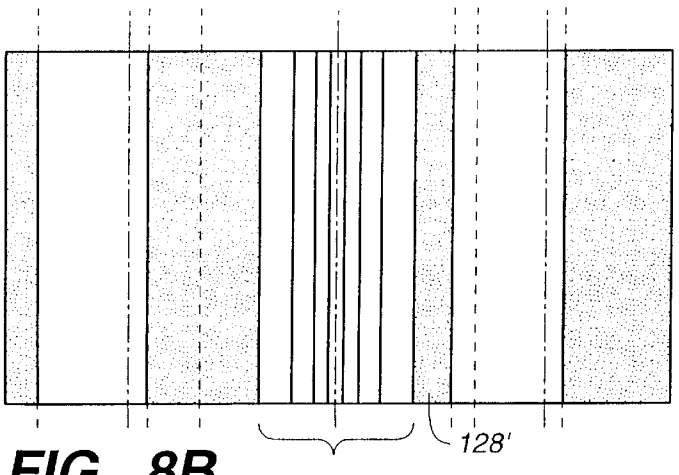
FIG. 8B is a top view of the cold cathode field emitter arrays of FIG. 8A and aligned with those of FIG. 8A to illustrate the invention.

As shown in FIG. 8B, only the portion marked as active area is effective in emitting electrons for addressing the pixel dot overlapping hole 32''' in FIG. 8A. This is due to the fact that the electrical field at the active area is higher than that outside such area, as can be seen from the eqipotential lines 74 caused by potentials of the anode and of the electrodes 62–68 in FIG. 3. Thus, in contrast to conventional field emitter displays, even though the metal layer 128' has been misaligned relative to the pixel or pixel dot of the anode, such misalignment does not significantly affect the quality of the display.

Thus, the field emitters in the active area may have a shorter lifetime compared to those in the outlying areas not within the active area as marked in FIG. 8B. These extra emitters will take up the slack when the field emitters in the active area have reached their lifetime and begin to fail. This is illustrated more clearly in reference to FIGS. 9A, 9B.

Figure 9A:
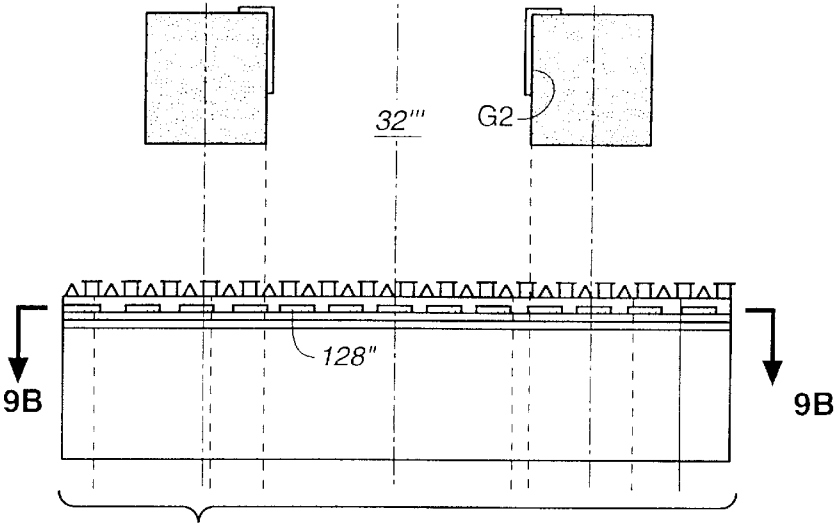
FIG. 9A is a cross-sectional view of portions of a spacer, grid electrodes and cold cathode field emitter arrays containing a segmented thin film metal electrode array to illustrate the invention.
Figure 9B:
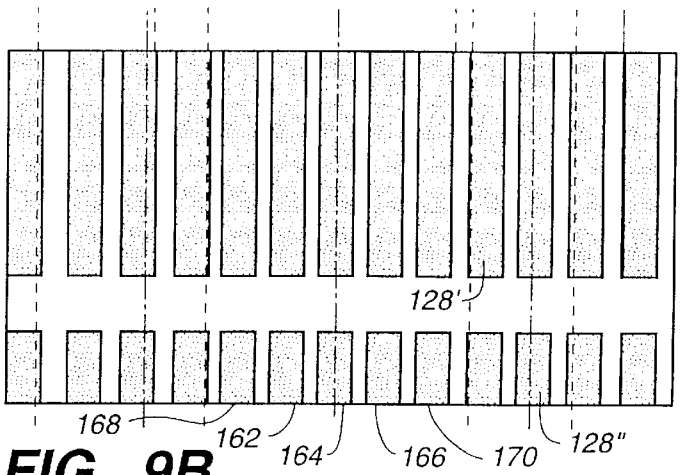
FIG. 9B is a top view of the segmented thin film metal electrode array of FIG. 9A not covered by other portions of the arrays to illustrate the invention.

FIG. 9A is a cross-sectional view of a portion of the display device similar to that in FIG. 8A, except that instead of the one large segmented thin film metal 128' in FIG. 8A, a number of narrower strips of segmented thin film metal layers 128" are used. FIG. 9B is a view of such thin film metal array taken along the line 9B—9B in FIG. 9A. Therefore, for reasons explained above, initially field emitters on top of strips 162, 164, 166 are active in emitting electrons. But as the field emitters over such three strips have reached their lifetime and begin to become defective, those on top of strips 168, 170 will become active and take up the slack. The configuration of FIGS. 9A, 9B may be advantageous since there is no need for aligning the segmented thin film metal strips with the hole 32''' in comparison to the configuration in FIGS. 8A, 8B.

Figure 10A:
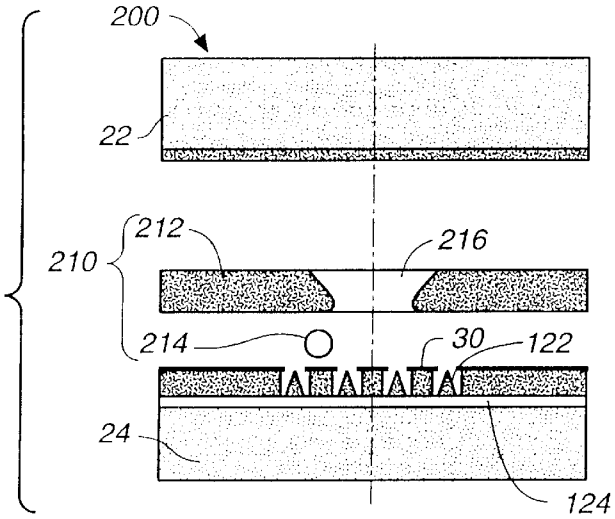
FIGS. 10A and 10B are cross-sectional views of a portion of a display device employing a metal mesh-grid wire spacer structure where each of the grid wires in the structure may be placed in a position that is near the edge of a hole in the metal mesh or in a position aligned with the center of the hole where the two metal meshes of the two figures have different shaped edges at the holes to illustrate the invention.

FIG. 10A is a cross-sectional view of a portion of the display device 200 which is similar in principle to device 20, 20', except that a different mesh-grid wire spacer structure 210 is employed in place of spacer 40 and grid electrodes 32, 32', 32" etc. As shown in FIG. 10A, the metal mesh-grid wire spacer structure 210 includes a metal mesh 212 and connected thereto a number of grid wires 214. Grid wire 214 has essentially the same function as that of the grid electrodes in FIGS. 1–3, that is, controlling the amount of electrons that will pass through hole 216. Electrical potentials are also applied to metal mesh 216 for focusing electrons to the desired pixel dot or pixel. Device 200 is advantageous since the metal mesh-grid wire spacer structure 210 is particularly adapted for low cost manufacturing, whereas the spacer 40 and grid electrodes thereon in FIGS. 1–3 require a number of steps of processing.

Figure 10B:
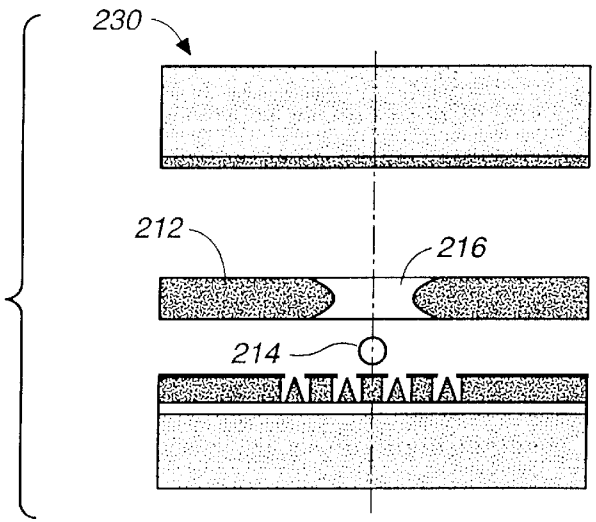

FIG. 10B is a cross-sectional view of a portion of a display device 230 substantially similar to device 200 of FIG. 10A, except for a slightly different shape of the edge of the metal mesh compared to that in FIG. 10A at the hole 216 and the location of the grid wire 214. In FIG. 10A, the grid wire 214 is placed near the edge of hole 216 and away from the position aligned with the center of the hole. In FIG. 10B, however, the grid wire 214 is placed in the position aligned with the center of the hole 216. Having a grid wire 214 off to the side near the edge of the metal mesh at hole 216 may be advantageous over the configuration in FIG. 10B where the grid wire is aligned with the center of the hole 216, since such position of the wire in FIG. 10B may block the passage of electrons through the hole.

Figure 10C:
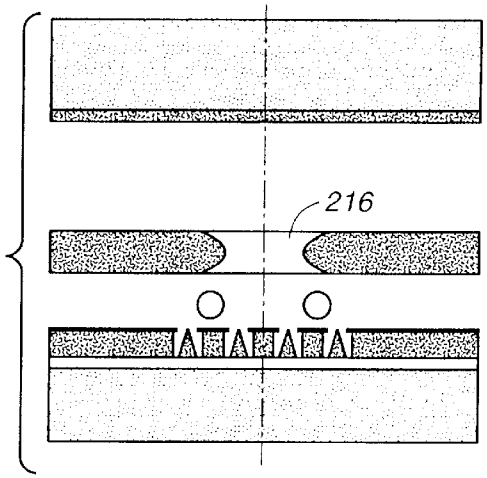
FIGS. 10C and 10D are cross-sectional views of portions of a display device employing a metal mesh-grid wire spacer structure with two or three grid wires in the structure corresponding to each hole and placed at the edge of and/or in position aligned with the center of the hole of the mesh to illustrate the invention.
Figure 10D:
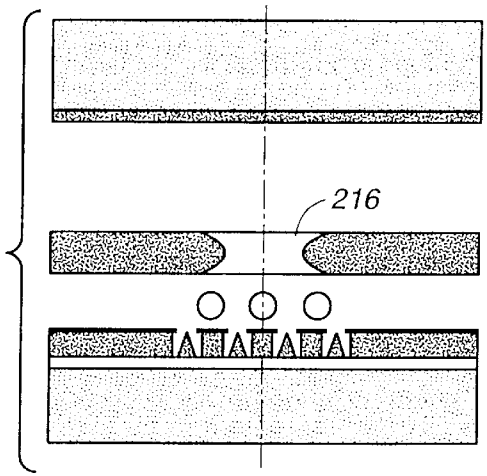

FIGS. 10C, 10D are further embodiments substantially similar to device 200, but where two or more grid wires are used instead of only one in FIGS. 10A, 10B. Thus, in FIG. 10C two grid wires are used, one on each side, both located near the edge of the hole 216. In FIG. 10D in addition to such two grid wires as in FIG. 10C, an additional grid wire located and aligned with the center of the hole 216 is also used.

Figure 11:
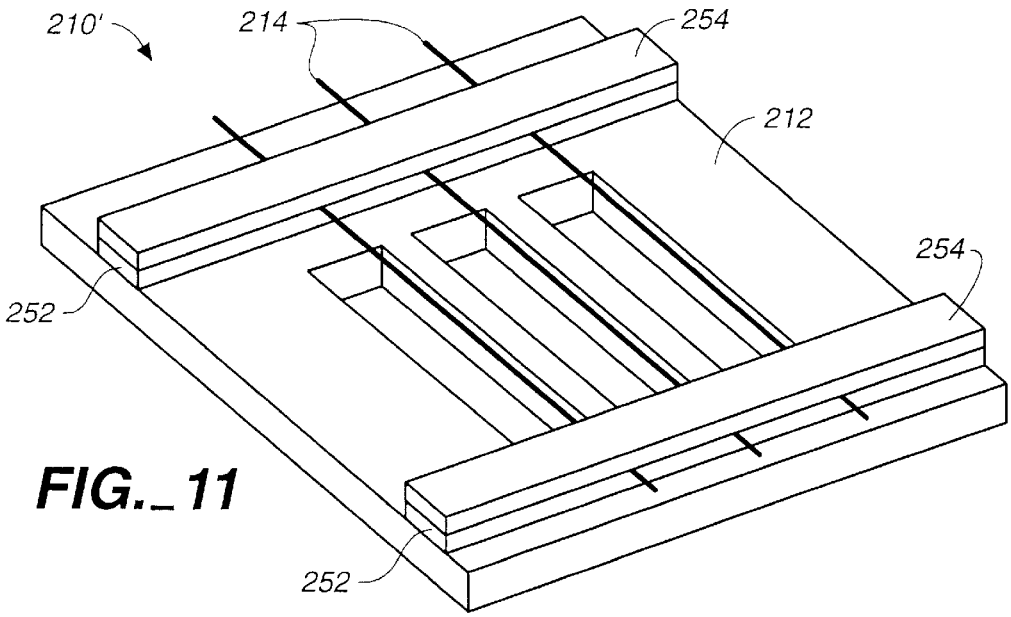
FIG. 11 is a perspective view of one embodiment of the metal mesh-grid wire spacer structure that can be used in FIGS. 10A–10D to illustrate the invention.

FIG. 11 is a perspective view of metal mesh 210' of FIG. 10B, illustrating how the grid wires and the metal mesh can be connected together. As shown in FIG. 11, two insulating bars 252 are first attached or deposited onto metal mesh 212. Grid wires 214 are then placed over such bars. A second pair of insulating bars 254 are then placed on top of the wires to clamp the wires in place. Before the bars 254 are securely attached to bars 252, wires 214 are placed in desired tension. Each set of bars 252, 254 may be used to clamp the grid wires for controlling 4, 8 or more adjacent pixel dots. The sum of thicknesses of the metal mesh 212 and grid wires may be greater than about 0.05 mm.

Figure 12:
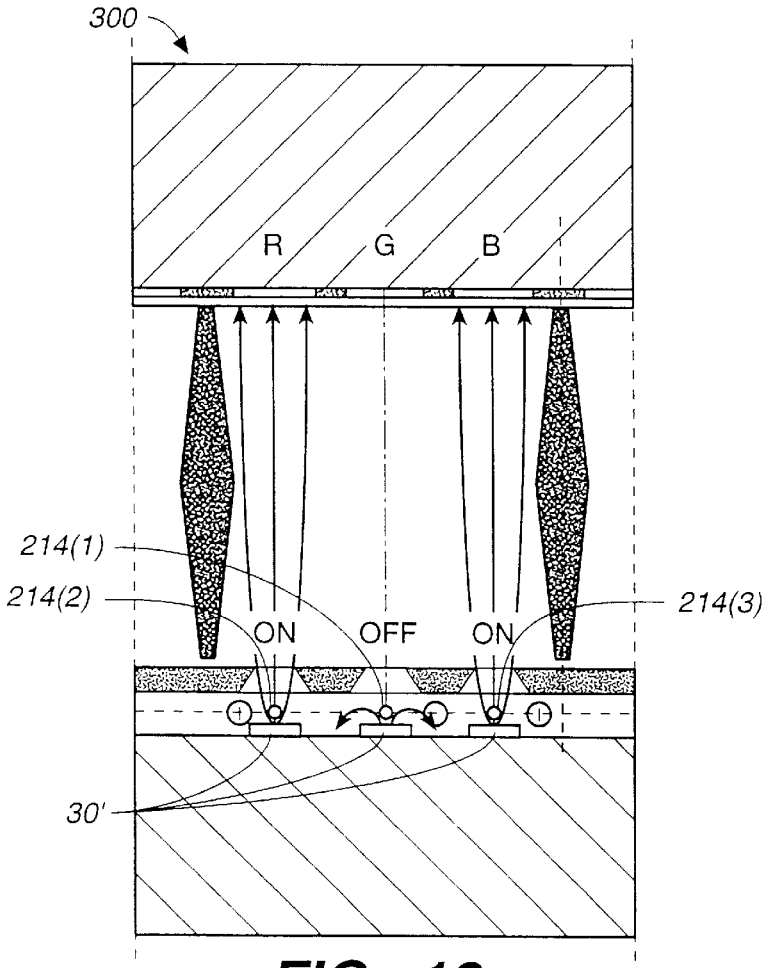
FIG. 12 is a schematic cross-sectional view of a portion of the display device of FIGS. 10A–10D and 11 to illustrate the operation of such device.

FIG. 12 is a cross-sectional side view of a portion of a display device 300 from the top or bottom edge similar to devices 200 and 200' to illustrate the operation of the device. The cathode field emitter elements in each row or array are arranged in clusters, in the manner shown in FIG. 4, each cluster overlapping a pixel dot R, G, or B when viewed in the viewing direction. As before, appropriate electrical potentials are applied to either the base electrode or the gates of all three of the cold cathode field emitters in the array 30' in order to control the turning on and off of the emitters in the arrays in order to scan the lines of pixels of the display. As illustrated in FIG. 12, the cold cathode field emitters are turned on so that electrons are emitted thereby. However, appropriate electrical potentials are applied to grid wire 214(1) to turn off the display of pixel dot G and to grid wires 214(2), 214(3) to turn on the display at pixel dots R, B and in order to modulate the brightness of the colors at dots R, B respectively.

Figure 13A:
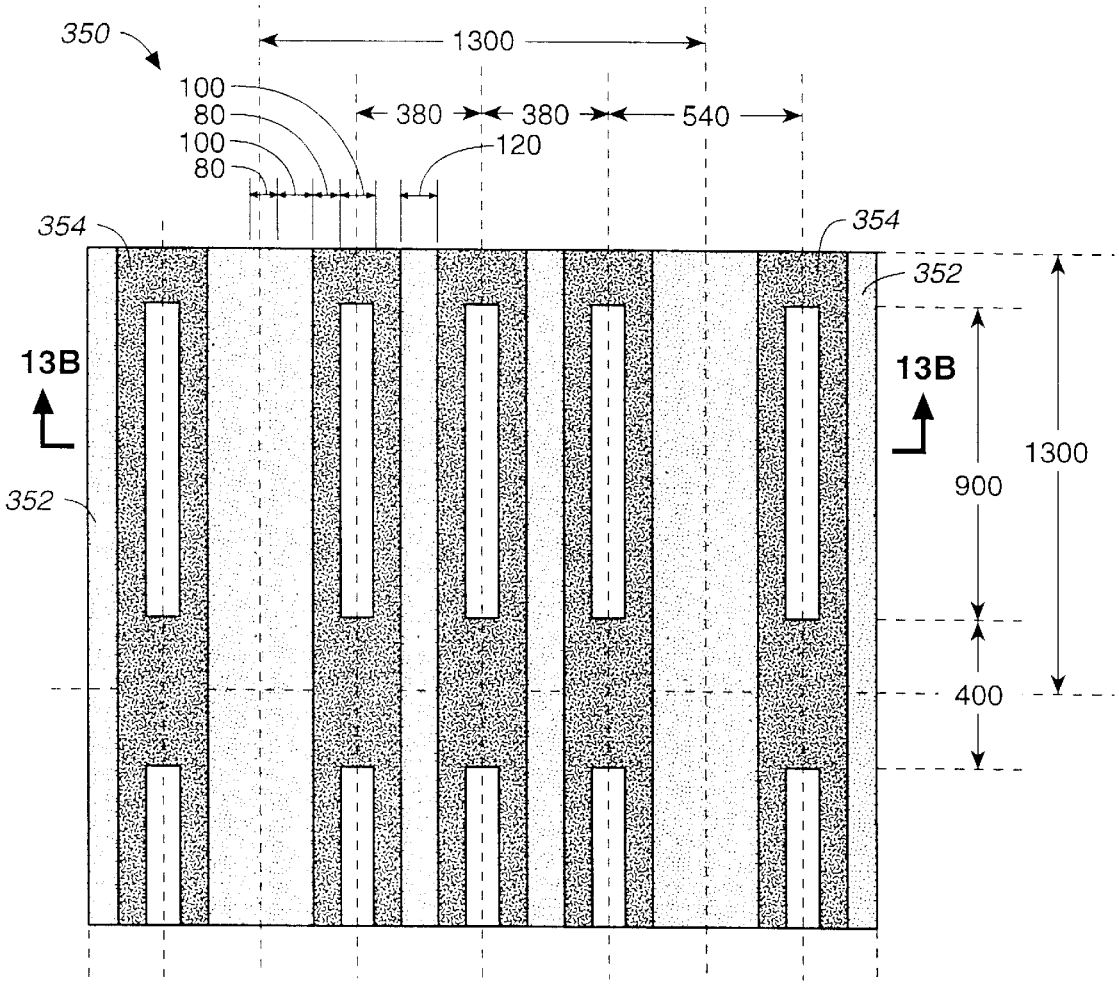
FIG. 13A is a top view of another embodiment of the metal mesh-grid wire spacer structure that can be used in FIGS. 10A–10D in place of the metal mesh-grid wire structure of FIG. 11 to illustrate the preferred embodiment of the invention.
Figure 13B:
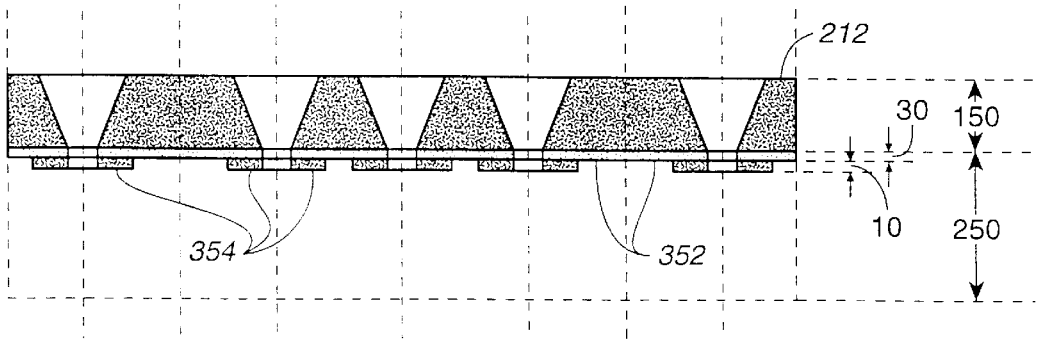
FIG. 13B is a cross-sectional view along the line 13B—13B in FIG. 13A of the structure of FIG. 13A to illustrate the preferred embodiment of the invention.

FIG. 13A is a top view of a portion of a metal mesh-grid wire structure 350 that can used in a display device to illustrate the preferred embodiment of the invention. FIG. 13B is a cross-sectional view of the structure 350 taken along the line 13B—13B in FIG. 13A. In reference to FIG. 11, a number of steps are required to mount the wires 214 to the metal mesh 212. Even though the steps for mounting a wire structure such as 400 in FIG. 14A is somewhat simpler, such steps are still cumbersome.

The process can be further simplified by forming the structure 350 instead by simply forming a layer of insulating material 352 on the planar surface on one side of the metal mesh and form one or more layers of an electrically conductive material 354 that will serve the same function as that of the grid wires of FIG. 12 described above. Layers 352 may be formed by screen printing a layer of dielectric material onto the metal mesh, using the mesh as a mask and differentially removing portions of the dielectric layer not masked by the mesh, such as by sandblasting. Layers 354 may be formed by laminating or screen printing a layer of photosensitive electrically conductive material onto said coating; and using the mesh as a mask and lithographically removing unmasked portions of the photosensitive electrically conductive layer. Layers 352 may also be formed by laminating or screen printing an insulating layer on the metal mesh 212, and unwanted portions of such layer removed by masking and photolithography. Since the mask used in such process can have a pattern different from that of the metal mesh, the resulting insulating layer can also be different in shape from the metal mesh.

Structure 350 is advantageous since it is particularly easy to manufacture. Thus, holes such as holes 216 of a predetermined pattern are first formed by masking a layer of metal by a mask with a desired pattern and then removing the unmasked portions of the layer using techniques including photochemical micromachining, laser ablation, molding and electroforming to form the metal mesh 212. Then, an insulating coating is formed on the metal mesh. A grid electrode pattern 354 is then formed on the insulating layer. The metal mesh-grid wire structure 350 is then complete and it is then inserted between an anode and at least one cathode to form a display device. Such structure can also be used in display devices other than those described above, such as ones that employ filament cathodes and not field emitters. Such and other variations are within the scope of the invention. The metal mesh-grid wire type structures shown in FIG. 10A through FIG. 13B are advantageous over the spacer grid electrode combination in FIGS. 1 and 2 since, unlike the spacer grid electrode combination of FIGS. 1 and 2, there is no need to coat the inside surfaces of holes with insulating layers and electrically conductive layers. The spacers are, therefore, much easier to manufacture and can be made arbitrarily thin, so that they can also be used in many types of display devices.

Figure 14A:
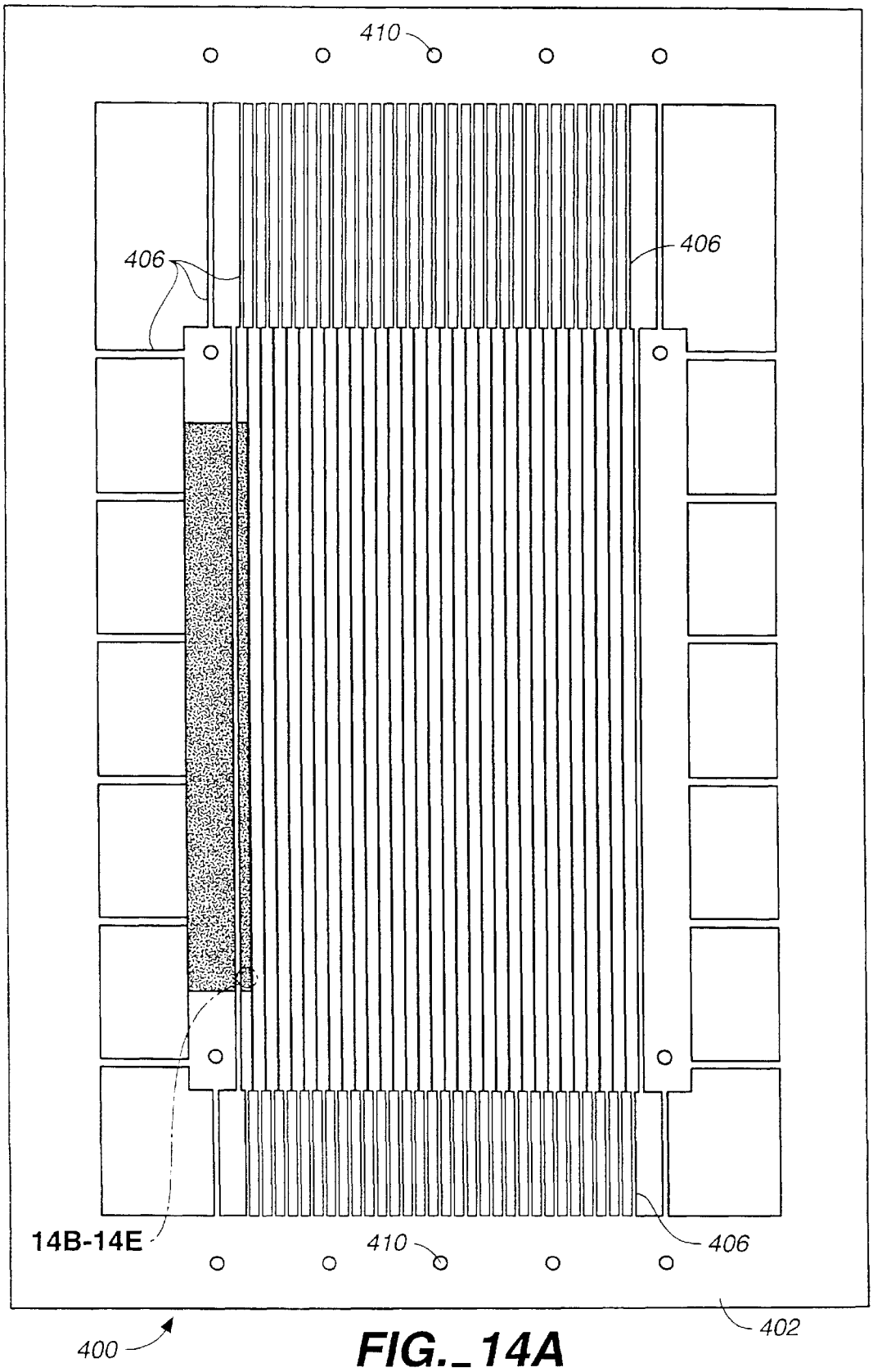
FIG. 14A is a top view of a grid wire structure that may be used in place of individual wires in the embodiment of FIGS. 10A–10D, 11 and 12 to illustrate the invention.

FIG. 14A is a top view of a grid wire structure that may be used in place of individual wires in the embodiment of FIGS. 10A–14D, 11 and 12 to illustrate a more advantageous way for making and mounting the wires onto the metal mesh 112 of these figures. As shown in FIG. 14A, a wire structure 400 may be fabricated in a manner similar to a metal lead frame in semiconductor packaging technology. Thus, the structure 400 may be in the form of a sheet of metal with the unwanted portions removed by stamping or etching. Structure 400 includes a rim 402 and individual wires 404 connected to the rim by connecting leads 406. Instead of having to align each wire individually with respect to a hole 216 in the mesh 212 as in the embodiment of FIGS. 10A–10D, 11 and 12, the wires 404 of the structure 400 may be aligned in one setting with a number of holes 216 for a number of pixel dots to speed up the alignment process. Holes 410 in the rim 402 are provided so that wires 404 may be placed at the desired tension by inserting pins (not shown) into the holes 410 and then pulling the pins apart. After the wires have been aligned and have the desired tension, they may be clamped between bars 252, 254 in the manner described above. The connecting leads 406 may then be severed so that adjacent leads are not electrically connected together. It should be noted that FIG. 14A is not drawn to scale so that the spacing between adjacent leads 404 is actually greater or preferably much greater than the cross-sectional dimensions of the wires 404 themselves.

Figure 14B:
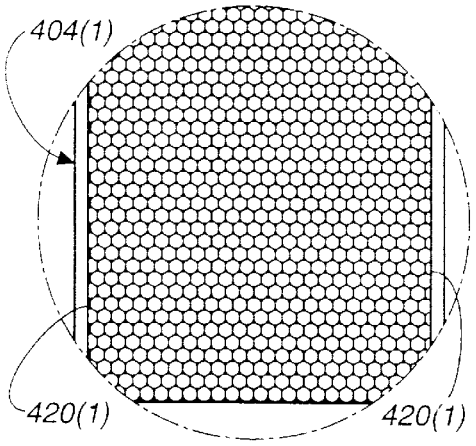
FIGS. 14B–14E are exploded views of a portion of the wire structure of FIG. 14A.
Figure 14C:
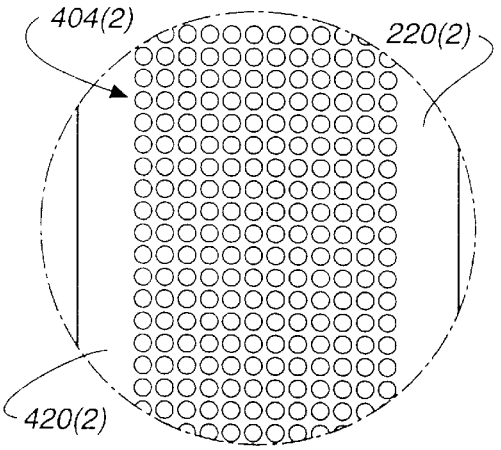
Figure 14D:
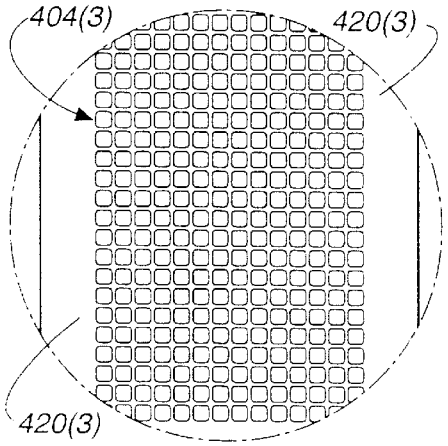
Figure 14E:
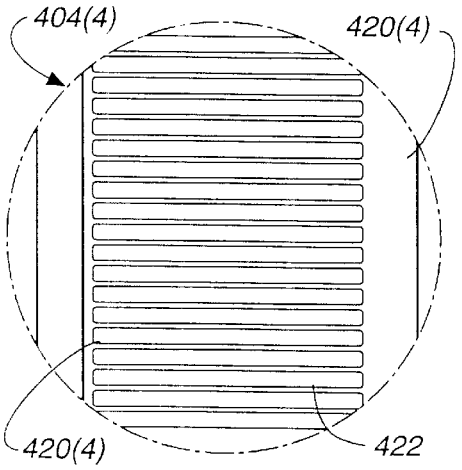

It is preferable for each individual wire 404 to have a mesh structure instead of being a solid piece of metal. Four different exploded views are shown in FIGS. 14B–14E which are exploded views of the portion of the wire within the circle 14B–14E in FIG. 14A to illustrate four different types of wires. As shown in FIG. 14B, wire 404(1) comprises a structure having two solid ribs or rims 420(1) on each side with a mesh-type structure connecting the two ribs or rims where the mesh contains honeycomb shaped holes therein. The wire 404(2) in FIG. 14C also has two ribs or rims 420(2) and a mesh structure therebetween having spherical or circular holes therein. Wire 404(3) in FIG. 14D has two ribs or rims 420(3) and a mesh structure therebetween having square or cubical shaped holes therein. The wire 404(4) in FIG. 14E also has two ribs or rims 420(4) connected together by thin wires 422.

While the invention has been described by reference to different embodiments, it will be understood that various changes and modifications may be made without departing from the scope of the invention which is to be defined only by the appended claims and their equivalent.

What is claimed is:

1. A cathodoluminescent visual display device having a plurality of pixel dots for displaying images when said device is viewed in a viewing direction, comprising:

a housing defining a chamber therein, said housing having a face plate, and a back plate;

an anode on or near said face plate;

luminescent means that emits light in response to electrons, and that is on or adjacent to the anode;

a plurality of rows of field emission cathode elements in the chamber between the face and back plates, said elements comprising base and gate electrodes, wherein at least one row of the elements includes more than one element;

a first spacer structure defining holes therein for passage of electrons;

a first set of elongated grid electrodes between the anode and cathode, said grid electrodes being transverse to the rows of cathode field emission elements, the electrodes overlapping the luminescent means and said rows at locations when viewed in the viewing direction, wherein the overlapping locations define rows and columns of pixel dots; and a circuit applying electrical potentials to the anode, cathode, the set of grid electrodes and the elements in the rows of field emission cathode elements, causing the cathode elements to emit electrons and such electrons to travel to the luminescent means at desired pixel dots on or adjacent to the anode for displaying images of desired brightness, said circuit applying electrical potentials to the rows of cathode field emission elements to control scanning or brightness of the display; wherein each of said field emission cathode elements comprises:

a base electrode;

a gate electrode electrically insulated from the base electrode;

a plurality of microtip structures;

a first set of resistors, each resistor in the first set electrically connected to a corresponding structure; and a current limiting circuit connected to the resistors having a constant current source so that the resistors and the circuit connect the base electrode to the microtip structures to limit total amount of current delivered by the base electrode to said plurality of microtip structures.

2. The device of claim 1, wherein the set of grid electrodes comprises layers of an electrically conductive material on the hole surfaces of the first spacer structure.

3. The device of claim 1, wherein the sum of thicknesses of the spacer structure and the grid electrodes is greater than about 0.05 mm thick.

4. The device of claim 1, wherein the hole surfaces of the first spacer structure are electrically conductive.

5. The device of claim 4, wherein the first spacer structure is electrically conductive.

6. The device of claim 5, further comprising a first insulating layer on the first spacer structure, wherein the set of grid electrodes comprises wires or a wire structure of an electrically conductive material on the first insulating layer.

7. The device of claim 6, further comprising a second insulating layer on the wires, said first and second insulating layers forming insulating bars clamping said wires so that the wires are at predetermined tensions.

8. The device of claim 5, wherein the set of grid electrodes comprises an electrically conductive layer on said first insulating layer.

9. The device of claim 1, wherein the first spacer structure is electrically insulative, said device further comprising an insulating layer on the first spacer structure, wherein the set of grid electrodes comprises layers of an electrically conductive material on the insulating layer.

10. The device of claim 9, wherein the set of grid electrodes comprises layers of an electrically conductive material on the hole surfaces of the first spacer structure.

11. The device of claim 10, said insulating layer and said electrically conductive material layer are on at least a portion of a surface of the first spacer structure facing the anode or the cathode elements.

12. The device of claim 1, the rows of field emission cathode elements being substantially perpendicular to the set of grid electrodes when viewed in the viewing direction.

13. The device of claim 1, wherein said circuit applies electrical potentials to the rows of field emission cathode elements to scan the rows so that, when each of the rows is scanned to emit electrons, the electrical potentials applied to the grid electrodes corresponding to the pixel dots of such row controls the switching on or off and to modulate the brightness of such pixel dots.

14. The device of claim 1, wherein each of at least some of the holes of said first spacer structure overlap a corresponding pixel dot.

15. The device of claim 1, said luminescent means comprising areas emitting light of different colors, each of at least some of said pixel dots overlapping one of such areas when viewed in the viewing direction, wherein said first spacer structure comprises walls dividing each of said at least some of the holes of said first spacer structure into smaller holes each of which overlapping a corresponding pixel dot when viewed in the viewing direction.

16. The device of claim 15, the pixel dots having a corresponding row of field emission cathode elements.

17. The device of claim 16, wherein said grid electrodes comprises at least one grid electrode in the vicinity of each corresponding smaller hole in the first spacer structure between the first spacer structure and the field emission cathode elements, and wherein said circuit applies electrical potentials to each of said at least one grid electrode to control the amount of electrons that pass through each corresponding smaller hole to control the switching on or off and to modulate the brightness of the pixel dot corresponding to such smaller hole, such pixel dot also defining the corresponding pixel dot of the grid electrode corresponding to such smaller hole.

18. The device of claim 17, wherein for each of at least some of the pixel dots, the corresponding grid electrode is between the smaller hole corresponding to such pixel dot and the row of field emission cathode elements corresponding to such pixel dot.

19. The device of claim 18, wherein for each of at least some of the pixel dots, the corresponding grid electrode is located between substantially the center of the smaller hole corresponding to such pixel dot and the row of field emission cathode elements corresponding to such pixel dot.

20. The device of claim 18, wherein for each of at least some of the pixel dots, the corresponding grid electrode is located on one side of the center of the smaller hole corresponding to such pixel dot.

21. The device of claim 17, wherein said grid electrodes comprise at least two grid electrodes in the vicinity of each corresponding smaller hole in the first spacer structure between the first spacer structure and the field emission cathode elements.

22. The device of claim 17, wherein the first spacer structure is electrically conductive, said device further comprising a first insulating layer on the first spacer structure, wherein the set of grid electrodes comprises wires of an electrically conductive material on the first insulating layer.

23. The device of claim 22, further comprising a second insulating layer on the wires, said first and second insulating layers forming insulating bars clamping said wires so that the wires are at predetermined tensions.

24. The device of claim 22, wherein said circuit applies electrical potentials to the rows of field emission cathode elements to scan the rows so that, when each of the rows is scanned to emit electrons, the electrical potentials applied to the grid wire electrodes corresponding to the pixel dots of such row controls the switching on or off and to modulate the brightness of such pixel dots.

25. The device of claim 24, said circuit also applying electrical potentials to said spacer structure to focus electrons passing through the holes.

26. The device of claim 25, the electrical potentials applied to the grid wire electrodes and the spacer structure being in the range of about +200 to −200 volts.

27. The device of claim 1, wherein each of said field emission elements comprises at least one gate electrode and at least one base electrode, said base electrode including microtips.

28. The device of claim 1, further comprising a second spacer between the first spacer and the face plate and a third spacer between the first spacer and the back plate to withstand atmospheric pressure.

29. The device of claim 28, wherein said second or third spacer comprises a plurality of rib segments, each rib segment co-extensive with a predetermined number of pixel dots.

30. The device of claim 1, wherein hole surfaces of the first spacer structure are electrically conductive, said circuit also applying electrical potentials to said spacer structure hole surfaces to focus electrons passing through the holes.

31. The device of claim 30, wherein each of at least some of the holes of said first spacer structure overlap a pixel dot, said circuit also applying electrical potentials to said spacer structure hole surfaces to focus electrons passing through the holes to predetermined pixel dots to scan and modulate the brightness at such dots.

32. The device of claim 1 wherein said constant current source includes a transistor.

33. A cathodoluminescent visual display device having a plurality of pixel dots for displaying images when said device is viewed in a viewing direction, comprising:

a housing defining a chamber therein, said housing having a face plate, and a back plate;

an anode on or near said face plate;

luminescent means that emits light in response to electrons, and that is on or adjacent to the anode;

a plurality of rows of field emission cathode elements in the chamber between the face and back plates, said elements comprising base and gate electrodes, wherein at least one row of the elements includes more than one element;

a first spacer structure defining holes therein for passage of electrons;

one or more sets of elongated grid electrodes between the anode and cathode, said grid electrodes overlapping the luminescent means, one another or said rows of field emission cathode elements at locations when viewed in the viewing direction, wherein the overlapping locations define rows and columns of pixel dots; and a circuit applying electrical potentials to the anode, cathode, the one or more sets of grid electrodes and the elements in the rows of field emission cathode elements, causing the cathode elements to emit electrons and such electrons to travel to the luminescent means at desired pixel dots on or adjacent to the anode for displaying images of desired brightness; wherein each of said field emission cathode elements comprises:

a base electrode;

a gate electrode electrically insulated from the base electrode;

a plurality of microtip structures;

a first set of resistors, each resistor in the first set electrically connected to a corresponding structure; and a current limiting circuit connected to the resistors having a constant current source so that the resistors and the circuit connect the base electrode to the microtip structures to limit total amount of current delivered by the base electrode to said plurality of microtip structures.

34. The device of claim 33, wherein said constant current source includes a transistor.

35. A cathodoluminescent visual display device having a plurality of pixel dots for displaying images when said device is viewed in a viewing direction, comprising:

a housing defining a chamber therein, said housing having a face plate, and a back plate;

an anode on or near said face plate;

luminescent means that emits light in response to electrons, and that is on or adjacent to the anode;

a plurality of rows of field emission cathode elements in the chamber between the face and back plates, said elements comprising base and gate electrodes, wherein at least one row of the elements includes more than one element, wherein each of said field emission cathode elements comprises:

a base electrode;

a gate electrode electrically insulated from the base electrode;

a plurality of microtip structures;

a first set of resistors, each resistor in the first set electrically connected to a corresponding structure; and a current limiting circuit connected to the resistors having a constant current source so that the resistors and the circuit connect the base electrode to the microtip structures to limit total amount of current delivered by the base electrode to said plurality of microtip structures; and a circuit applying electrical potentials to the anode and the base and gate electrodes of the elements, causing the elements to emit electrons and such electrons to travel to the luminescent means at desired pixel dots on or adjacent to the anode for displaying images of desired brightness.

36. The device of claim 35, wherein said constant current source includes a transistor.

* * * * *